US005592148A

United States Patent [19]

Morales

[11] Patent Number: 5,592,148

[45] Date of Patent: Jan. 7, 1997

[54] SAFE-DISTANCE WARNING SYSTEM FOR EMF GENERATORS

[76] Inventor: Nicholas S. Morales, 3126 W. 70th St., Hialeah, Fla. 33016

[21] Appl. No.: 628,886

[22] Filed: Apr. 5, 1996

Related U.S. Application Data

[63] Continuation-in-part of Ser. No. 489,836, Jun. 13, 1995.

[51] Int. Cl.[6] ..... G08B 21/00

[52] U.S. Cl. ..... 340/540; 340/522; 340/541; 340/552; 340/600

[58] Field of Search ..... 340/540, 541, 340/552, 600, 522

[56] References Cited

U.S. PATENT DOCUMENTS

| | | | |
|---|---|---|---|
| 4,032,910 | 6/1977 | Hollway et al. | 340/600 |
| 4,321,593 | 3/1982 | Ho et al. | 340/541 |
| 5,309,097 | 5/1994 | Bill et al. | 340/600 |
| 5,408,276 | 4/1995 | Morales | 348/818 |
| 5,532,681 | 7/1996 | Peters et al. | 340/540 |

*Primary Examiner*—Glen Swann
*Attorney, Agent, or Firm*—Robert C. Kain, Jr.

[57] ABSTRACT

The warning system includes, in one embodiment, an antenna which is tuned to an EMF frequency generated by the EMF radiating device. These EMF radiating devices may be televisions, computer monitors, cathode ray tubes or microwave ovens. An RF receiver and converter is electrically connected to the antenna. The converter generates a first control signal in the presence of the EMF radiation from the EMF radiating device. A motion sensor is mounted adjacent to the EMF radiating device. The motion sensor generates a second control signal when the motion sensor detects a moving object within a detection range. A switch, electrically connected to the converter and the motion sensor, receives the first and second control signals. The switch generates activation signals dependent upon the first and second control signals. A visual warning alarm is electrically connected to the switch and issues visual warnings dependent upon the activation signal. Additionally, an audio warning alarm is electrically connected to the switch and generates an audio alarm dependent upon the activation signals.

7 Claims, 1 Drawing Sheet

SAFE-DISTANCE WARNING SYSTEM FOR EMF GENERATORS

This is a continuation-in-part of Ser. No. 08/489,836, filed Jun. 13, 1995, now pending.

The present invention relates to a distance warning system for electromagnetic field radiating devices such as televisions, microwave ovens, computer monitors, and other common appliances.

BACKGROUND OF THE INVENTION

The effects of electromagnetic fields or EMF radiation exposure on humans is currently under study. The United States Environmental Protection Agency, in a December 1992 publication 402-R-92-008, entitled *Electromagnetic Fields in Your Environment* indicates that recent scientific studies have suggested a link or a statistical association between exposure to 60 Hertz EMF radiation and certain types of cancer, primarily leukemia and brain cancer. It is known that there are several primary factors which must be considered in order to determine the possible hazards of EMF radiation exposure. These factors are the strength of the EMF field, the distance between the observer and the EMF source, and the duration of the exposure. It is known that the strength of the field decreases exponentially based upon the straight line distance between the source of the field and the observation point. The frequency and amplitude of the EMF waves are also important.

Additionally, certain appliances, such as microwaves, are known to be a hazard to people wearing pacemakers. Further, it has been speculated in some scientific journals that expectant mothers may also be affected by these EMF radiating appliances. There is also a growing concern that EMF exposure may affect individuals who watch television for extended periods of time. Additionally, widespread use of computer monitors, which generate EMF radiation, have been the subject of scientific discussion.

OBJECTS OF THE INVENTION

It is an object of the present invention to provide an electronic warning system which alerts unsuspecting individuals of the presence of EMF radiation.

It is an additional object of the present invention to provide a system which warns individuals with either an audible or a visual alarm or both of the EMF radiation.

It is an additional object of the present invention to provide visual alarms which may illuminate or flash a visual message to individuals in proximity to the warning system.

It is a further object of the present invention to provide a warning system which can be disposed near or on the top of EMF radiating devices such as TVs and microwaves.

It is an additional object of the present invention to provide a warning which can be programmed such that an individual may walk by the device without triggering the alarm, that is, the alarm circuit includes a delay.

SUMMARY OF THE INVENTION

The warning system includes, in one embodiment, an antenna which is tuned to an EMF frequency generated by the EMF radiating device. These EMF radiating devices may be televisions, computer monitors, cathode ray tubes or microwave ovens. An RF receiver and converter is electrically connected to the antenna. The converter generates a first control signal in the presence of the EMF radiation from the EMF radiating device. A motion sensor is mounted adjacent to the EMF radiating device. The motion sensor generates a second control signal when the motion sensor detects a moving object within a detection range. A switch, electrically connected to the converter and the motion sensor, receives the first and second control signals. The switch generates activation signals dependent upon the first and second control signals. A visual warning alarm is electrically connected to the switch and issues visual warnings dependent upon the activation signal. Additionally, an audio warning alarm is electrically connected to the switch and generates an audio alarm dependent upon the activation signals.

BRIEF DESCRIPTION OF THE DRAWINGS

Further objects and advantages of the present invention can be found in the detailed description of the preferred embodiment when taken in conjunction with the accompanying drawings in which.

DETAILED DESCRIPTION OF THE PREFERRED EMBODIMENT

The present invention relates to a warning system for devices generating electromagnetic field (EMF) radiation. EMF radiating devices include, among other things, televisions, computer monitors, cathode ray tubes and microwave ovens. The following EMF Generator Table illustrates these and other items.

| EMF Generator Table |
|---|
| Television sets |
| Monitors (e.g., computer monitors) |
| Cathode ray tubes |
| Microwave ovens and heaters |
| Miscellaneous other appliances |

Figure 1:
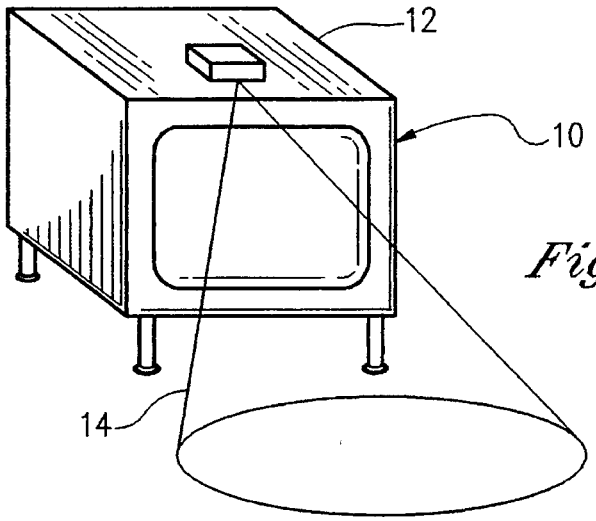
FIG. 1 diagrammatically illustrates an EMF radiating device and the warning system mounted adjacent to that EMF radiating device.

FIG. 1 diagrammatically illustrates one type of EMF radiation device which is a television 10. Atop or adjacent to television 10 is the container holding the warning system 12. As discussed later in connection with FIG. 2, warning system 12 includes a motion sensor. The motion sensor has a detection range diagrammatically shown as range 14. In this embodiment, the detection range for the motion detector has been focused in an area in front of television 10. As is known, infants and young children commonly sit very close to television 10 in order to gather a maximum amount of information from the television. The small distance between the child and the TV increases the possibility that the child may be adversely affected by EMF radiation generated by the cathode ray tube in television 10.

The motion sensor in warning system 12 can provide a wide range of detection areas (areas other than that shown in FIG. 1). The motion sensor can be modified to detect motion within a 360 degree range around warning system 12. This may be advantageous if the television or the microwave oven was placed in a retail establishment where individuals may walk around the operating TV or microwave oven. The claims appended hereto are meant to cover such motion detectors.

Figure 2:
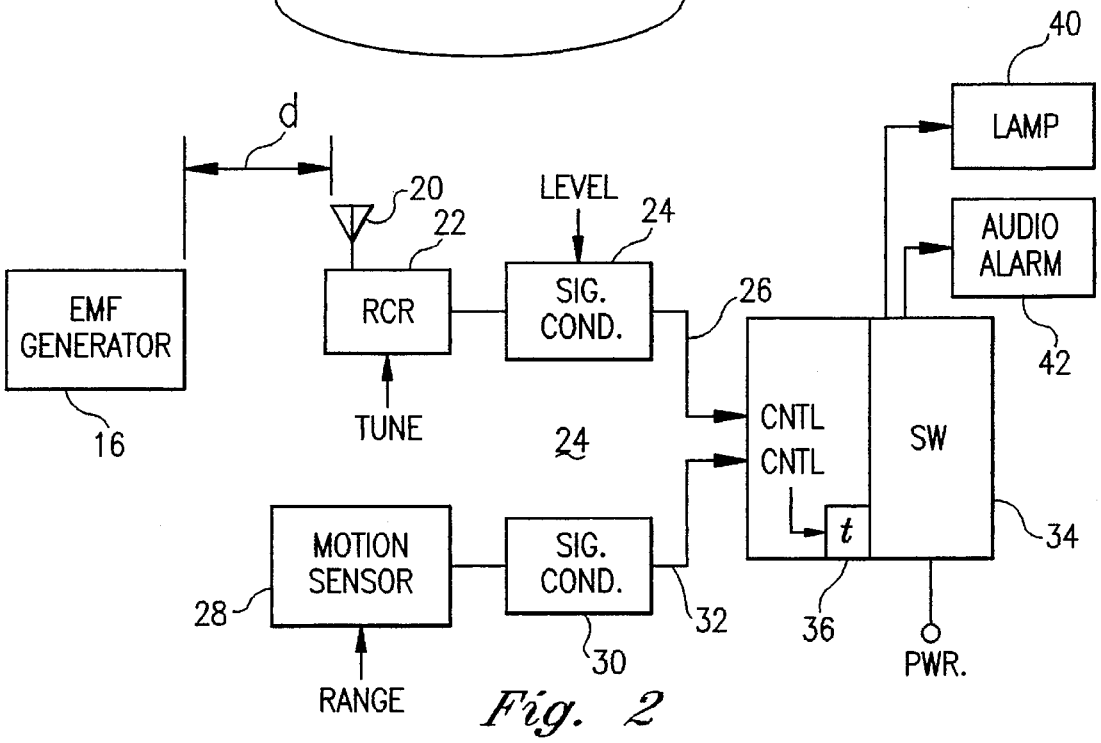
FIG. 2 diagrammatically illustrates the functional block elements of the warning system.

FIG. 2 diagrammatically illustrates the functional elements of the warning system. The warning system is placed a small distance d away from EMF generator or radiating device 16. In order to determine whether EMF radiating device 16 is ON or is generating EMF radiation, the warning system 18 includes an antenna 20 and a receiver circuit 22. The receiver circuit and the antenna is tuned to the EMF frequency generated by EMF radiating device 16. The output of receiver 22 is applied to a signal conditioning circuit 24. If the warning system is configured as a digital system, signal conditioner 24 would include an analog to digital converter. Otherwise, the warning system 18 may be an analog device. In this instance, the signal conditioning circuit 24 may simply amplify the output of receiver 22 and filter that output as necessary. Further, signal conditioner 24 may include some type of threshold limiting or detection device such that antenna 20, receiver 22 and conditioner 24 only generate a first control signal on line 26 in the presence of a reasonably significant or large amount of EMF radiation generated by EMF generator 16. In this manner, the warning system can be adjusted to be activated at different EMF levels by changing the threshold level in the signal conditioner circuit 24.

Warning circuit 18 also includes a motion sensor 28. Motion sensor 28 includes a control input that establishes the range or the scope of the detection range. The output of motion sensor 28 is applied to a signal conditioner 30. In a digital environment, signal conditioner 30 would include an A/D converter. In an analog environment, signal conditioner 30 would include amplifiers, level detectors and other filtering and analog circuits which enable the output of motion sensor 28 to be configured as a second control signal on line 32. The first and second control signals identified in FIG. 2 as CNTL are applied to switch 34. As a further enhancement, the control signal from motion sensor 28 may be applied to a delay circuit. Delay circuit 36 delays the application of the motion control signal a predetermined time t. The predetermined time can be adjusted at the factory or by the user. This feature enables the present invention to delay the generation of a visual or an audio alarm if a person quickly walks by the television set, computer monitor or other EMF generating device.

Power is also applied to switch 34. Ultimately, switch 34 applies power as an activation signal to a visual alarm such as lamp 40 and an audio alarm such as unit 42. In practice, lamp 40 may be a light, a blinking light, or may be an LED message display. Switch 34 may apply activation control commands to lamp 40 and audio alarm 42 rather than a power control signal.

The audio alarm unit 42 may be an electronic sound chip, a beeper, a tone or a speaker. In a most advanced system, the audio alarm may actually issue a voice response such as "Beware. You have entered an EMF radiation field".

The following Switch Table and Audio Warning Table provide some variations on the switch and the audio warning systems that can be utilized.

| Switch Table |
|---|
| Transistors |
| Relays |
| Logic circuits |
| **Audio Warning Table** |
| Beeps |
| Tones |
| Series of tones |
| Voice messages |

Switch 34 can be configured in several operating modes. In one mode, the antenna 20 and receiver 22 turn ON the warning system as soon as EMF radiation generator 16 is turned ON. If the EMF radiator generates a low level of radiation, the signal conditioner 24 may disable or turn OFF the first control signal. Assuming that EMF generator 16 is generating a predetermined and detectable amount of EMF radiation, switch 34 can be configured such that lamp or visual alarm 40 is turned ON when the EMF source is ON. However, audio alarm unit 42 would not be turned ON unless someone moved or walked through the motion detection range shown in FIG. 1.

Switch 34 can be further configured such that visual alarm 40 issues a different type of visual alarm such as a blinking or displaying a visual message when the motion sensor is activated ON. In addition to this supplemental visual alarm, audio alarm 42 is activated to audibly indicate to the intruder in detection range 14 that he or she is subject to EMF radiation. Alternatively, switch 34 can be configured such that the visual alarm is always indicating when the unacceptable amount of EMF radiation is being detected by antenna 20 and receiver 22 and the audio alarm 42 is only activated ON when someone moves through the detection range.

Additionally, switch 34 can be configured such that delay circuit 36 turns ON the audio alarm only after a significantly long period of time (for example, 15 –20 minutes). In this manner, the person who is present within the detection range must be within that range for a significant period of time. Since EMF radiation exposure is a function of the strength of the field, the distance to the observer and the exposure time, that exposure time may be monitored by warning system 12.

Figure 3:
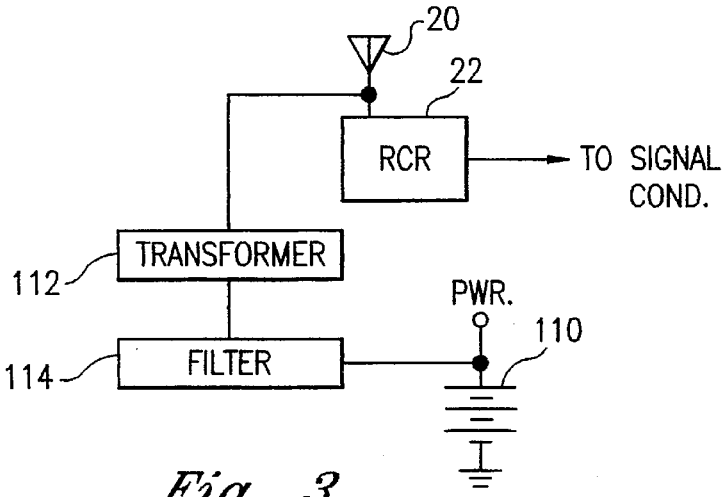
FIG. 3 diagrammatically illustrates a power supply circuit utilizing the EMF energy to charge a battery as part of the system.

FIG. 3 diagrammatically illustrates an EMF power circuit for charging battery 110 (which may be a nickel-cadmium or other rechargeable battery). A step-up transformer 112 is connected to antenna 20. The stepped-up voltage signal is then applied to filter 114. The filter includes, among other things, a diode bridge or rectifier to change the sinusoidal wave from transformer 112 into a D.C. power signal. The output of filter 114 is applied to battery bank 110. Battery bank 110 supplies power (PWR) to the other circuit elements (see FIG. 2). In this manner, the system is powered by the EMF signals.

The claims appended hereto are meant to cover modifications and changes within the spirit and scope of the present invention.

What is claimed is:

1. A warning system for devices generating electromagnetic field (EMF) radiation such as televisions, cathode ray tubes, computer monitors, and microwave ovens comprising:

an antenna tuned to an EMF frequency generated by said EMF radiating device;

means for converting an output of said antenna into a first control signal in the presence of said EMF radiation from said EMF radiating device;

a motion sensor mounted adjacent said EMF radiating device, said motion sensor generating a second control signal when said motion sensor detects a moving object within a detection range about said motion sensor;

a switch electrically coupled to said means for converting and said motion sensor and receiving said first and second control signals, said switch generating activation signals dependent upon said first and second control signals;

a visual warning alarm electrically coupled to said switch, said visual warning alarm being activated by said activation signals from said switch; and, an audio warning alarm electrically coupled to said switch, said audio warning alarm being activated by said activation signals from said switch.

2. A warning system as claimed in claim 1 wherein said switch includes means for generating a visual activation signal upon receipt of said first control signal, said means for generating applying said visual activation signal to said visual alarm and thereby indicating that said EMF radiating device is in operation.

3. A warning system as claimed in claim 2 wherein said switch includes means for generating an audio activation signal upon receipt of said first and second control signals, said means for generating said audio activation signal applying said audio activation signal to said audio alarm and thereby indicating that said object is passing through said motion detection range near said EMF radiating device while said EMF radiating device is in operation.

4. A warning system as claimed in claim 3 wherein said antenna, said means for converting, said motion detector and said switch are all mounted in a container, said container being adopted to be disposed adjacent said EMF radiating device.

5. A warning system as claimed in claim 3 including means for delaying the generation of said audio activation signal prior to application to said audio alarm.

6. A warning system as claimed in claim 1 including means for concurrently applying said activation signals to both said audio alarm and said visual alarm.

7. A warning system as claimed in claim 5 including means for adjusting said motion detection range about said motion detector.

* * * * *